US010428513B2

(12) United States Patent
Jesse-Windelband et al.

(10) Patent No.: US 10,428,513 B2
(45) Date of Patent: Oct. 1, 2019

(54) CONNECTION DEVICE BETWEEN A GUTTER AND GULLY

(71) Applicant: ACO Severin Ahlmann GmbH & Co. Kommanditgesellschaft, Büdelsdorf (DE)

(72) Inventors: Bengt Jesse-Windelband, Osterröfeld (DE); Stephen Meier, Albersdorf (DE); Michael Muller, Monkeberg (DE); Michael Sieber, Timmaspe (DE)

(73) Assignee: ACO SEVERIN AHLMANN GMBH & CO. KG, Budelsdorf (DE)

( * ) Notice: Subject to any disclaimer, the term of this patent is extended or adjusted under 35 U.S.C. 154(b) by 0 days.

(21) Appl. No.: 16/075,756

(22) PCT Filed: Feb. 22, 2017

(86) PCT No.: PCT/EP2017/054080
§ 371 (c)(1),
(2) Date: Aug. 6, 2018

(87) PCT Pub. No.: WO2017/144542
PCT Pub. Date: Aug. 31, 2017

(65) Prior Publication Data

US 2019/0055726 A1 Feb. 21, 2019

(30) Foreign Application Priority Data

Feb. 24, 2016 (DE) ..... 10 2016 103 279

(51) Int. Cl.
*E03F 5/04* (2006.01)
*E03F 3/04* (2006.01)

(52) U.S. Cl.
CPC ..... *E03F 5/041* (2013.01); *E03F 3/046* (2013.01); *E03F 5/0401* (2013.01); *E03F 2005/0413* (2013.01)

(58) Field of Classification Search
CPC combination set(s) only.
See application file for complete search history.

(56) References Cited

U.S. PATENT DOCUMENTS 4,832,527 A * 5/1989 Bachmann ..... E02B 7/28 405/103
6,626,201 B1 * 9/2003 Kim ..... E03F 5/042 137/1
2007/0177941 A1 8/2007 Villarreal et al.

FOREIGN PATENT DOCUMENTS

DE 2447871 A1 4/1976
DE 29503911.6 5/1995

(Continued)

*Primary Examiner* — Kyle Armstrong
(74) *Attorney, Agent, or Firm* — Pearne & Gordon LLP

(57) ABSTRACT

Connection devices for connecting a drainage gutter to a further functional element (10), for example to an inlet box, are known, which comprise an adapter plate (20) to which the drainage gutter can be connected. In order to ensure simple assembly on the building site in combination with a high degree of tightness, it is proposed to provide a cast-in part (40) which can be tightly cast into a wall of the functional element (10) and comprises fastening devices by means of which the adapter plate (20) can be fixedly connected to the cast-in part (40) in such a way that a flow space (2) of the drainage gutter can be tightly connected to an interior of the functional part (10) via a transfer space.

8 Claims, 4 Drawing Sheets

(56) References Cited

FOREIGN PATENT DOCUMENTS

Figure 1:
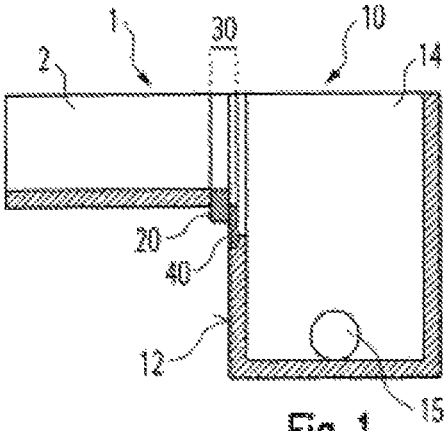

| | | | |
|---|---|---|---|
| DE | 102006053345 | A1 | 5/2008 |
| WO | 2005012661 | A1 | 2/2005 |

* cited by examiner

CONNECTION DEVICE BETWEEN A GUTTER AND GULLY

The invention concerns a connection device for connecting a drainage gutter to a further functional element according to the preamble of claim 1.

Inlet boxes for drainage gutter systems, which are provided with such connection devices, are known from DE 103 44 828 A1 or DE 44 25 940 C1.

According to DE 103 44 828 A1, one side of the inlet box is provided with a wall that may be cut out and which, in its contour, can be adapted to that of the drainage gutter that is to be connected. Said known arrangement requires some "tinkering" at the building site and does not seal very well.

The system according to DE 44 25 940 C1 utilizes a height-adjustable connector, although the achievable tightness is relatively low with this known product as well.

It is the object of the invention to provide a connection device of the type described at the outset which can provide excellent sealing capacity whilst at the same time is easy to install at the building site.

Said object is met by a connection device according to claim 1.

Said object is achieved in particular with regard to a connection device for connecting a drainage gutter to a further functional element, for example to an inlet box, a point discharge or a gully, comprising an adaptor plate to which a drainage gutter may be connected, which is solved in that an inlet part is provided which may be cast into a wall of the functional element and which comprises attachment facilities by means of which the adapter plate may be solidly attached to the inlet part so that a flow space of the drainage gutter can be connected via a transfer space sealed to an inner space of the functional part.

A significant point of the invention lies therefore in the fact that an inlet part is provided at the functional element, which may be attached to an adaptor part that connects to the drainage gutter. Said attachment means not only makes it possible to seal the arrangement but also provides an assembly that is mechanically easy to manage.

The inlet part is preferably manufactured from a hard plastic, for example ABS. Two-component parts are of course also possible. The inlet part is provided at the rear end with protrusions which may be cast in or anchored respectively in the drainage gutter that is preferably manufactured from polymer concrete. This creates a fluid-impermeable connection between the inlet part and the functional element, that is, the inlet box (described later without wishing to imply a limitation). It is also conceivable that the inlet part is attached by means of an adhesive to the functional element. This way it is possible, for example, to attach the inlet part at the building site or to replace the inlet part at the building site.

The adapter plate is preferably attached to the inlet part in a manner that is height-adjustable. This makes it possible to install gutters of different heights easily but also securely and leak-proof.

A serration is preferably provided between the inlet part and the adapter plate to facilitate a defined adjustment of the two parts to each other. A serration of this kind makes it much easier to achieve the correct alignment of the drainage gutter to the inlet box, and it also provides greater stability of the connection between adapter plate and inlet part in vertical direction.

The adapter plate may preferably be cut to length to adapt it to a lesser height of a drainage gutter. It is possible, for example, that at least one sealing strip is provided at the front of the inlet part and/or at the back of the adapter part, which is made from a soft plastic material such as TPU, NBR or EPDM. Said sealing strips are solidly cast into the harder plastic (ABS) as two-component parts. It is also possible to make the sealing strip from cork or natural rubber.

The inlet part is preferably provided with a removable separating wall, in particular a blind cover, so as to completely close off the inner space of the functional element or inlet box respectively. The inlet part may be provided with cutting marks to simplify the cutting out of pre-defined cast-in wall parts. Through the cutting-out of predefined cast-in wall parts it is possible to quickly and easily adapt the inlet box to drainage gutters of different heights.

The inlet part and/or the adapter plate are preferably provided with locking devices for the detachable locking and joining of the adapter plate with the inlet part. This facilitates the fabrication of a solid construction in a simple manner.

The adapter plate and/or the inlet part are provided with seals at different heights and are made to be able to be cut to size so that, if adapting it to a particularly high drainage gutter, at least an upper seal can be removed to increase the height of the transfer space. This achieves an increased variability of the overall arrangement.

The invention also concerns a system for the connection of drainage gutters to functional elements, for example to an inlet box. The system comprises at least one inlet part which may be cast into a wall of the functional element, and at least two adapter plates, which differ from each other in that drainage gutters of different heights may be fluid-impermeably connected to the functional element. The advantages of this arrangement have been described above.

Figure 2:
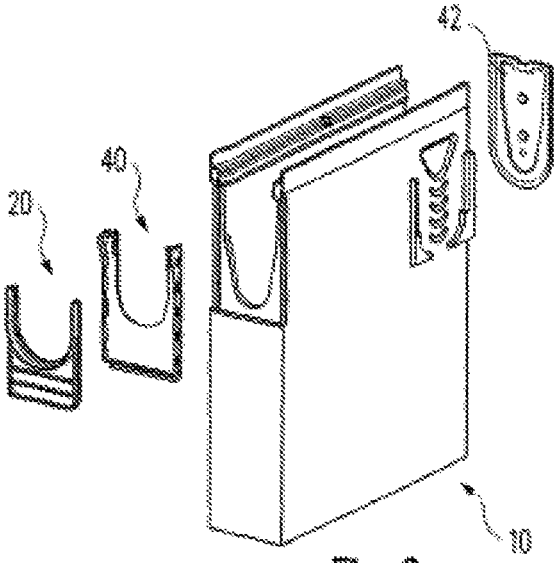
Figure 3:
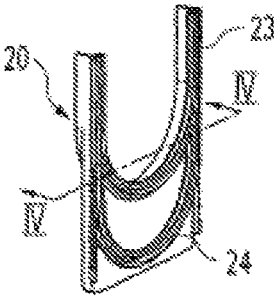
Figure 4:
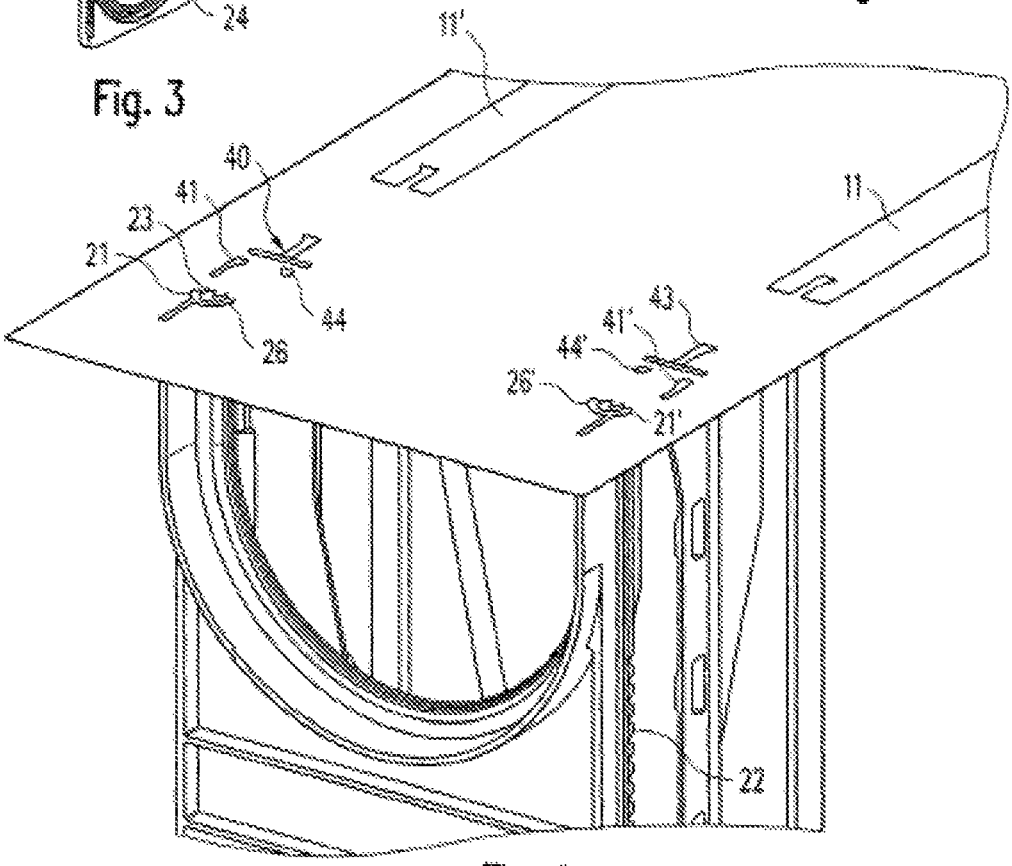
Figure 5:
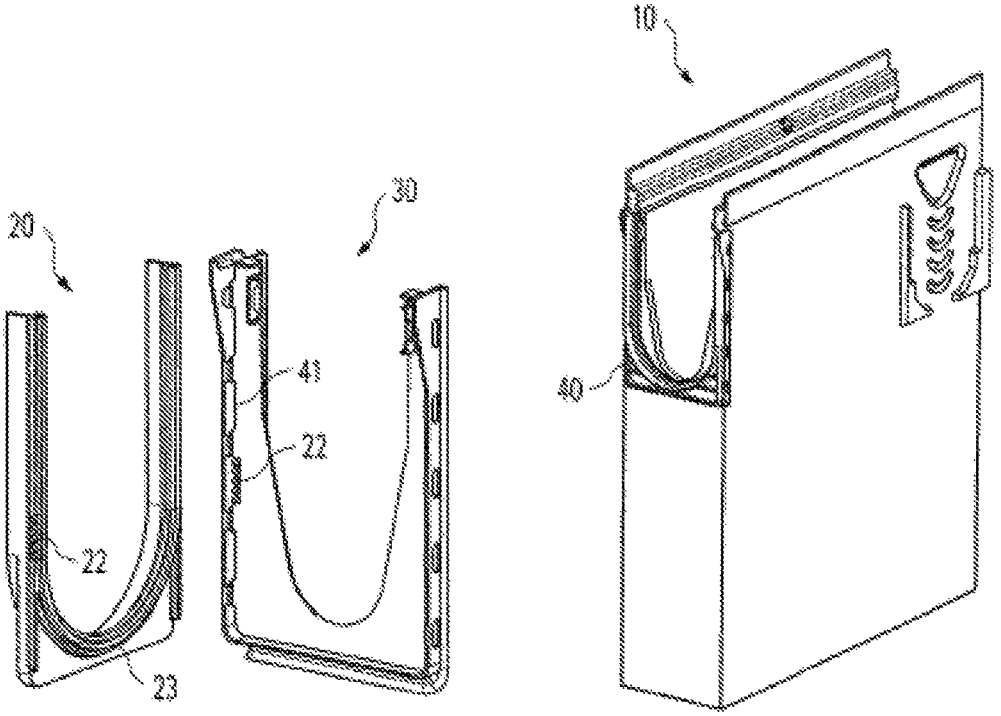
Figure 6:
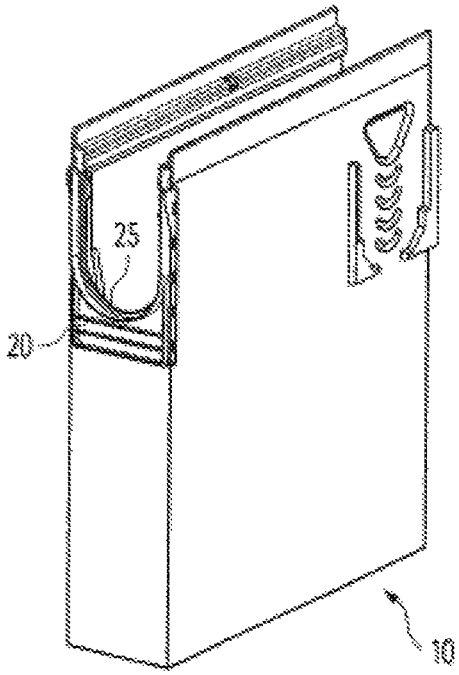
Figure 7:
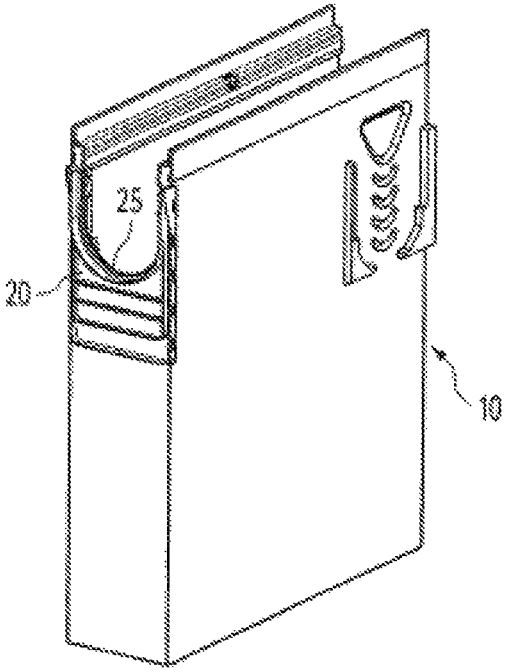
Figure 8:
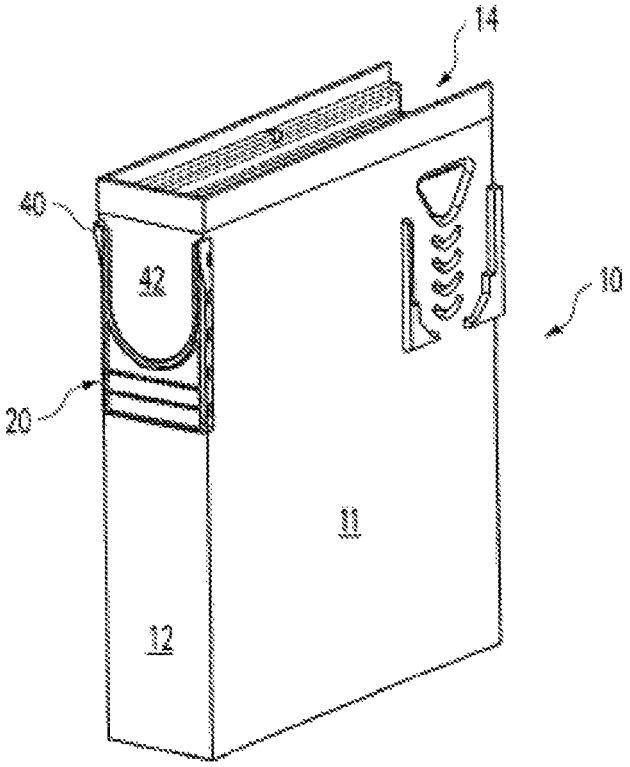
Figure 9:
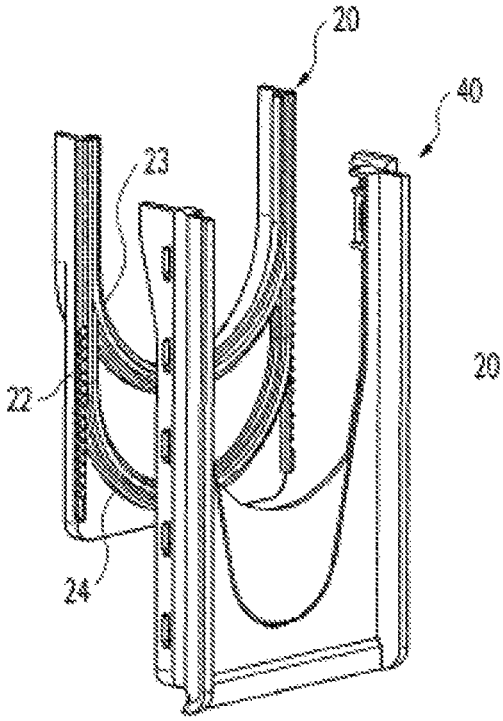
Figure 10:
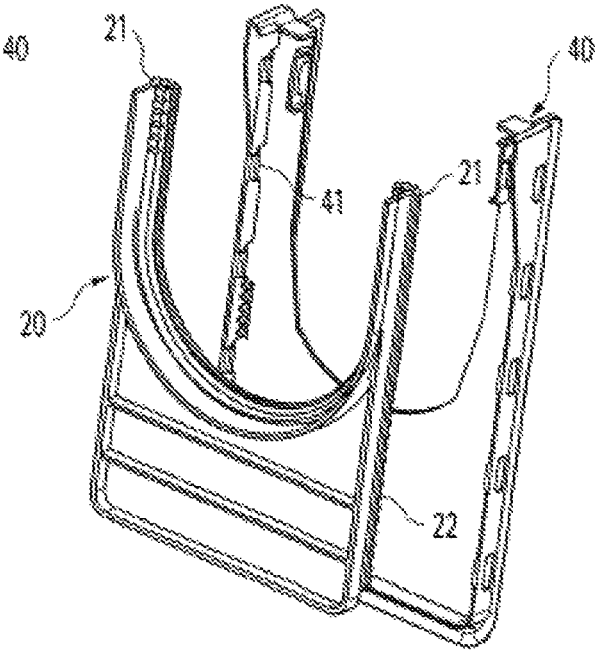

Preferred embodiments of the invention will now be explained in greater detail by way of the drawings. Shown are in:

FIG. 1 a highly schematic cross-section through an inlet box with connection device and drainage gutter;

FIG. 2 a partially exploded, perspective view of a connection device with inlet box;

FIG. 3 a perspective representation of the rear end of the adapter plate in FIG. 2 (complete gutter);

FIG. 4 a section along the plane IV-IV in FIG. 3;

FIG. 5 an inlet box with adapter plate to explain the connection between adapter plate and inlet part;

FIGS. 6 & 7 inlet boxes with adapter plates attached;

FIG. 8 an inlet box with closed adapter plate;

FIG. 9 a perspective representation of an inlet part with adapter plate from the back;

FIG. 10 the parts according to FIG. 9 at an angle from the front, and

Figure 11:
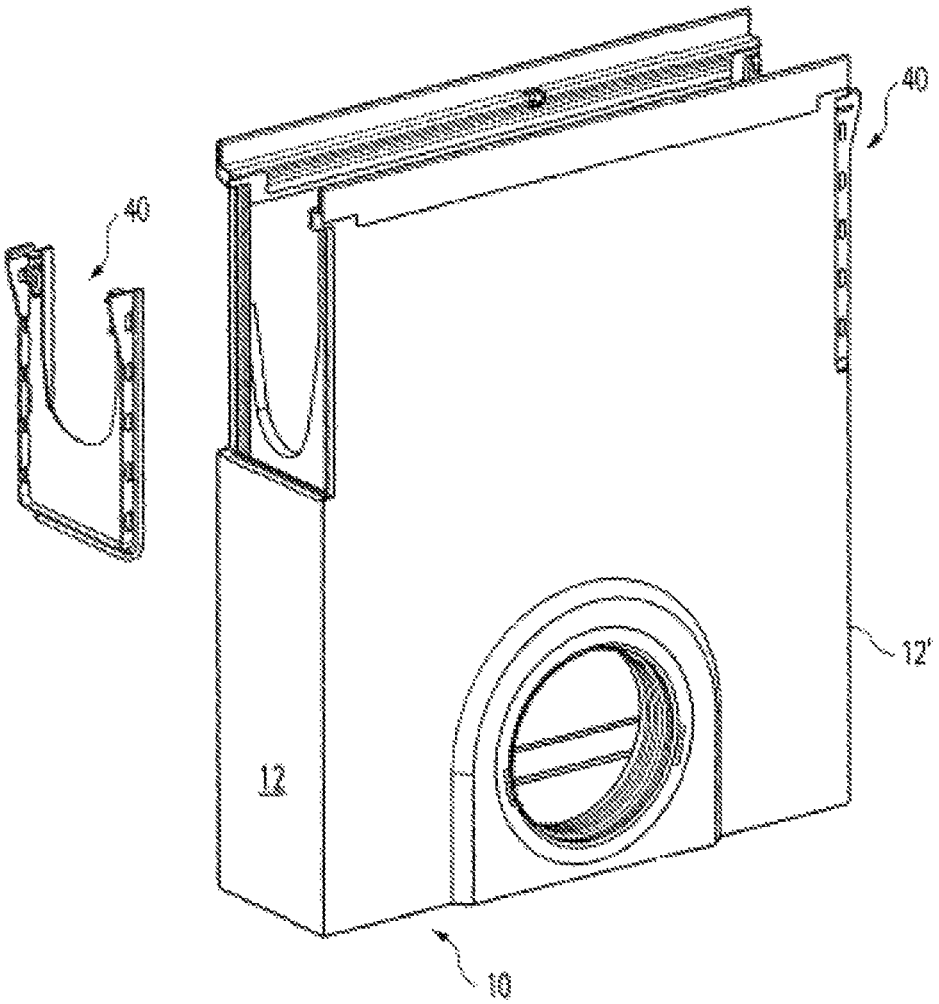

FIG. 11 an inlet box similar to that of FIG. 2 with unlocked frame.

The following description uses the same reference numbers for parts that are the same and have the same function.

According to the highly schematic cross-section of FIG. 1 a functional element 10 is provided that takes the form of an inlet box. An internal space 14 of inlet box 10 is provided at its lower edge with an outlet 15 to which a discharge pipe may be connected.

Cast into an end wall 12 is an inlet part 40 to which an adapter plate 20 may be attached. The inlet part 40 and the adapter plate 20 are each provided with an inner space, wherein both said inner spaces together form a transfer space 30.

A drainage gutter 1 is attached to the adapter plate 20 in such a way that its flow space 2 feeds into the transfer space 30 and via the same into the inner space 14 of the functional element 10.

FIG. 2 shows a perspective view of an inlet box 10 together with an inlet part 40 and an adapter plate 20 in an exploded view. Moreover, a blind element 42 can be seen, which is also cast into the functional element 10, wherein said blind element 42 is provided with cutting marks for the pre-defined cutting out of separating wall parts to connect, for example, a further drainage gutter.

As shown in FIG. 3, the adapter plate 20 is provided at its rear end with seals 23, 24 so that it is sealed when attached to the inlet part 40, as shown in FIG. 2.

By way of FIG. 4 it is now explained how the functional element 10 interacts with the adapter plate 20 and the inlet part 40. FIG. 4 shows a section though a plane that corresponds to the plane IV-IV of FIG. 3, wherein the inlet part 40 and the adapter plate 20 are drawn separately in exploded view from the functional element 10. The inlet part 40 is provided at its back end with a casting fillet 43, which is cast into the functional element 10, which provides a secure and leak-proof grip between the inlet part 40 and the functional element 10.

Moreover, the inlet part 40 has a circumferential frame that is provided with undercuts 41, 41' and retainers 44, 44', which are shaped such that an adapter plate 20 with outer edges 21, 21' and inner edges 26, 26' may be inserted behind the undercuts 41, 41' or retainers 44, 44' respectively, so that the seal 23 is disposed securely between inlet part 40 and adapter plate 20. The adapter plate 20 is provided at its back end with a serration 22, which engages with a corresponding opposite serration (not shown) of the inlet part 40. This provides adjustability of the adapter plate 20 in vertical direction relative to the inlet part 40.

The adapter plate 20 on the other hand may be cut off at the top so that an alignment of drainage gutters 1 of different heights, which are to be connected, is possible.

The functionality of the retainers of the adapter plate 20 on the inlet part 40 is again shown again in FIG. 5 more clearly. This also shows again the serrations 22 through which a height adjustment is possible.

FIGS. 6 and 7 show adapter plates 20 of different lengths with the same inlet parts 40 in the functional elements 10. In this instance the manufacturer may provide the adapter plates 20 already in different lengths, or a longer adapter plate (6) is cut at the top and forms then the shorter adapter plate according to FIG. 7.

FIG. 8 depicts a functional element 10 that has an inlet part 40 cast into its end face 12, which is closed off with a blind cover 42. FIGS. 9 and 10 depict again the combinations between inlet part 40 and adapter plate 20 to clearly show the adjustability of the adapter plate 20 in vertical direction relative to the inlet part 40 whilst at the same time fixing it in all other directions. FIG. 9 also shows that the adapter plate 20 may be provided with a higher seal 23 and a lower seal 24 so that it is possible to connect a drainage gutter of low height as well as one of greater height to the adapter plate 20.

The embodiment shown in FIG. 11 differs from the one shown in FIG. 2 primarily in the unlocked frame and the symmetrical arrangement of the inlet part 40 on the end walls 12, 12'.

LIST OF REFERENCE NUMBERS

1 Drainage gutter
2 Flow space
10 Functional element
11, 11' Side wall
12, 12' End wait
13 Bottom
14 Inner space
15 Outlet
20 Adapter plate
21, 21' Outer edge
22 Serration
23 Seal
24 Seal
25 Cut-out
26, 26' Inner edge
30 Transfer space
40 Inlet part
41, 41' Undercut
42 Separating wall/Blind cover
43 Casting fillet
44, 44' Retainer

The invention claimed is:

1. A connection device for connecting a drainage gutter (1) to a functional element (10) comprising an adapter plate (20) to which a drainage gutter (1) is connected, wherein an inlet part (40) is connected on a wall (12) of the functional element (10) and which comprises attachment facilities (41, 41'; 44, 44') with which the adapter plate (20) is attached to the inlet part (40) such that a flow space (2) of the drainage gutter (1) is connected via a transfer space (30) to an inner space (14) of the functional part (10), and the adapter plate (20) comprises a serration (22) along two ends of the adapter plate (20) that contacts and engages with an opposite serration (22) on the inlet part (40) to provide adjustability of the adapter plate (20) in a vertical direction relative to the inlet part (40), and wherein the adapter plate (20) comprising a higher seal (23) and a lower seal (24) disposed between the inlet part (40) and the adapter plate (20) to seal the inlet part (40) with the adapter plate (20), the higher seal (23) and the lower seal (24) being at different heights for connecting the drainage gutter (1) at different heights to the adapter plate (20).

2. The connection device according to claim 1, wherein the adapter plate (20) is attached to the inlet part (40).

3. The connection device according to claim 2, wherein the adapter plate (20) is cut off for adaptation to the drainage gutter (1).

4. The connection device according to claim 1, wherein the inlet part (40) is provided with a seal (23, 24).

5. The connection device according to claim 1, wherein the inlet part (40) is provided with a removable separating wall (42), the separating wall (42) being cut out for the complete sealing of the inner space (14).

6. The connection device according to claim 1, wherein the inlet part (40) or the adapter plate (20) are provided with locking devices (41, 21) for the detachable locking and joining of the adapter plate (20) with the inlet part (40).

7. The connection device according to claim 1, wherein at least one of the seals (23, 24) is removed to increase the height of the transfer space (30).

8. A system for the connection of drainage gutters (1) to functional elements (10), comprising at least one inlet part (40) cast into a wall (12) of the functional elements (10), and at least two adapter plates (20) so that the drainage gutters (1) of different heights may be connected fluid-impermeably to the functional elements (10), wherein the at least two adapter plates comprise a serration (22) that contacts and engages with an opposite serration (22) on the at least one inlet part (40) to provide adjustability of the at least two adapter plates (20) in a vertical direction relative to the at least one inlet part (40), the at least two adapter plates (20) comprising a higher seal (23) and a lower seal (24) disposed between the inlet part (40) and the at least two adapter plates (20) to seal the at least one inlet part (40) with the adapter plates (20), the higher seal (23) and the lower seal (24) being at different heights for connecting the drainage gutters (1) of different heights to the at least two adapter plates (20).

* * * * *